US009004039B2

(12) United States Patent
Straub

(10) Patent No.: US 9,004,039 B2
(45) Date of Patent: Apr. 14, 2015

(54) CYLINDER LUBRICATION SYSTEM

(71) Applicant: GM Global Technology Operations LLC, Detroit, MI (US)

(72) Inventor: Robert D. Straub, Lowell, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 101 days.

(21) Appl. No.: 13/658,333

(22) Filed: Oct. 23, 2012

(65) Prior Publication Data

US 2014/0109862 A1 Apr. 24, 2014

(51) Int. Cl.

| | |
|---|---|
| ***F02F 3/00*** | (2006.01) |
| ***F01M 1/08*** | (2006.01) |
| ***F01M 1/14*** | (2006.01) |
| ***F01M 1/16*** | (2006.01) |
| ***F02F 1/20*** | (2006.01) |

(52) U.S. Cl.

CPC . *F01M 1/16* (2013.01); *F01M 1/08* (2013.01); *F01M 1/14* (2013.01); *F02F 1/20* (2013.01)

(58) Field of Classification Search

USPC ..... 123/193.6, 193.4, 193.2

See application file for complete search history.

(56) References Cited

U.S. PATENT DOCUMENTS

| | | | | | |
|---|---|---|---|---|---|
| 1,092,042 | A * | 3/1914 | Hagar | 123/73 A |
| 5,002,025 | A * | 3/1991 | Crouse | 123/196 M |
| 5,570,668 | A * | 11/1996 | Hsu | 123/193.2 |
| 5,776,315 | A * | 7/1998 | Lowry | 196/46.1 |
| 6,105,724 | A * | 8/2000 | Stitz et al. | 184/7.4 |
| 6,792,910 | B2 * | 9/2004 | Haman et al. | 123/196 R |
| 7,284,526 | B2 * | 10/2007 | Williams | 123/193.6 |
| 2008/0202465 | A1 * | 8/2008 | Allen et al. | 123/196 R |
| 2009/0024223 | A1 * | 1/2009 | Chen et al. | 623/23.63 |

* cited by examiner

*Primary Examiner* — Lindsay Low
*Assistant Examiner* — Omar Morales
(74) *Attorney, Agent, or Firm* — Cantor Colburn LLP

(57) ABSTRACT

A cylinder lubrication system comprises a cylinder liner defining a cylinder, a piston reciprocally mounted in the cylinder for axial travel along a cylinder axis and having a piston skirt that moves in close proximity with the cylinder, an oil supply passage extending substantially circumferentially about an outer surface of the cylinder liner, an oil supply line fluidly connecting the oil supply passage to an oil supply, a series of small holes extending radially through the cylinder liner, from the cylinder to the oil supply passage, and operable as oil passages for lubricating oil from the oil supply to flow to the upper portion of the cylinder.

20 Claims, 2 Drawing Sheets

CYLINDER LUBRICATION SYSTEM

FIELD OF THE INVENTION

Exemplary embodiments of the invention relate to engine cylinder lubrication systems and, more particularly, lubrication for cylinders having low upper cylinder lubrication not readily lubricated by crankcase oil.

BACKGROUND

Internal combustion engines typically require adequate lubrication between all moving parts to assure efficient operation and long life. This is especially true between the cylinder walls and the cylinders. In certain engine types such as 2-stroke engines and other engines which do not rely on crank case provided oil for lubrication of the cylinder/cylinder wall lubrication, alternate ways of lubrication have to be provided. Historically 2-stroke engines have used a mixture of fuel, oil and air as the combustion charge to provide such lubrication. However, with increasing focus on emissions from internal combustion engines, the addition of oil as a combustion component of the combustion charge has in some cases caused 2-stroke engines to become out of favor for certain applications in favor of what are viewed as cleaner emitting 4-stroke engines even though in some instances the 2-stroke engine may be preferred due to weight and power advantages. A recent application of 2-stroke cylinders has been in combination with 4-stroke engines in a single unit with 2-stroke cylinders providing exhaust gas solely to the 4-stroke cylinders as recirculated exhaust gas ("EGR"). While this application may solve the emissions challenges of the 2-stroke design, it does not necessarily eliminate the challenge of upper cylinder lubrication.

SUMMARY

In one exemplary embodiment an internal combustion engine comprises a cylinder liner defining a cylinder, a piston reciprocally mounted in the cylinder for axial travel along a cylinder axis and having a piston skirt that moves in close proximity with the cylinder, an oil supply passage extending substantially circumferentially about an outer surface of the cylinder liner, an oil supply line fluidly connecting the oil supply passage to an oil supply, a series of small openings extending radially through the cylinder liner, from the cylinder to the oil supply passage, and operable as oil passages for lubricating oil from the oil supply to flow to the upper portion of the cylinder.

The above features and advantages, and other features and advantages of the invention are readily apparent from the following detailed description of the invention when taken in connection with the accompanying drawings.

BRIEF DESCRIPTION OF THE DRAWINGS

Other features, advantages and details appear, by way of example only, in the following detailed description of embodiments, the detailed description referring to the drawings in which.

DESCRIPTION OF THE EMBODIMENTS

Figure 1:
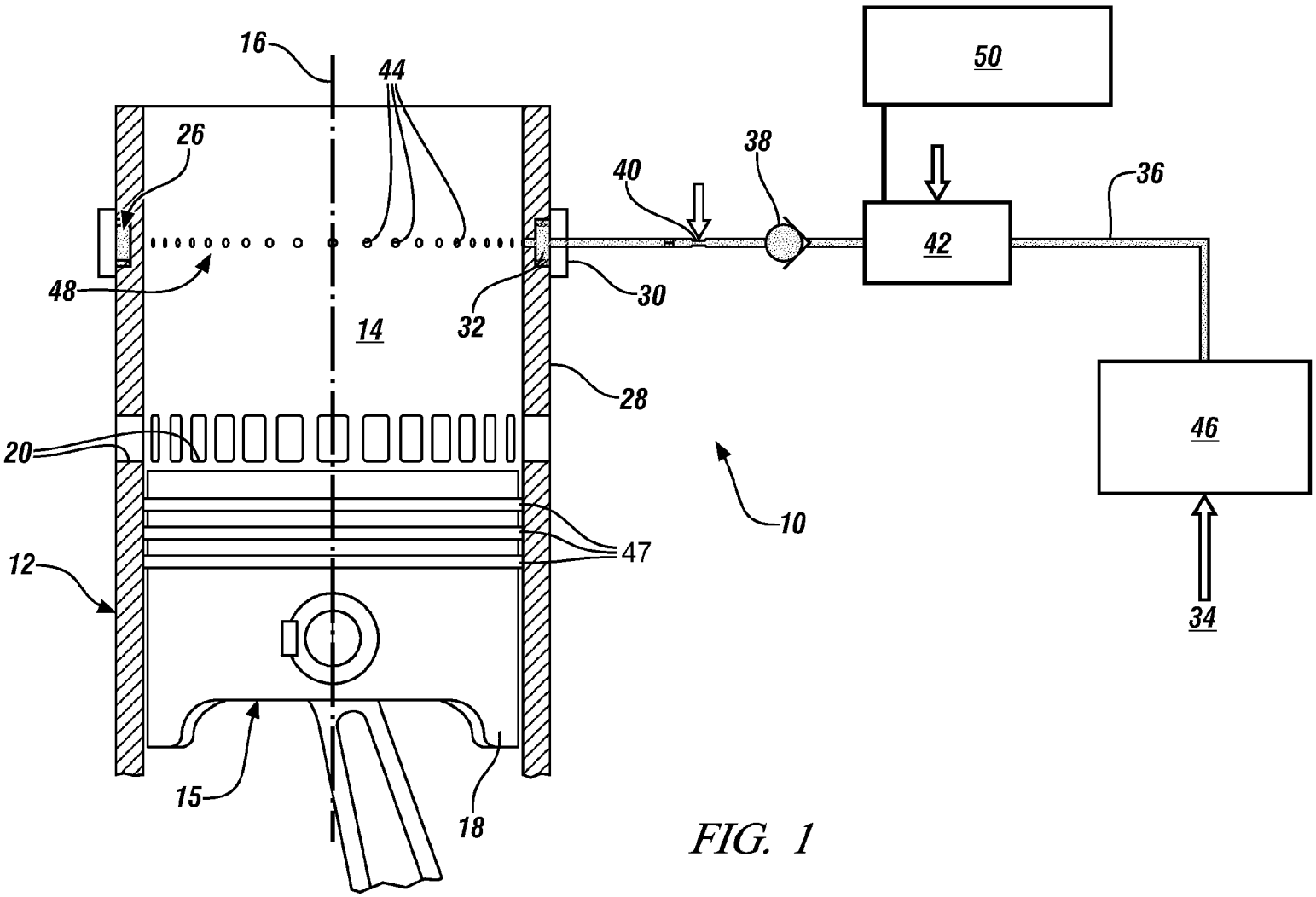
FIG. 1 is a schematic diagram of a lubrication system for an internal combustion engine embodying the invention.

The following description is merely exemplary in nature and is not intended to limit the present disclosure, its application or uses. It should be understood that throughout the drawings, corresponding reference numerals indicate like or corresponding parts or features. As used herein, the term module or control module refers to an application specific integrated circuit (ASIC), an electronic circuit, a processor (shared, dedicated or group) and memory that executes one or more software or firmware programs, a combinational logic circuit, and/or other suitable components that provide the described functionality.

Referring now to FIG. 1, an exemplary embodiment is directed to a piston that reciprocates within a cylinder and, in the exemplary embodiment, portions of an internal combustion engine 10. The internal combustion engine, in this example a 2-stroke engine, comprises a cylinder liner 12 containing a cylinder 14 having a piston 15 reciprocally mounted therein for axial travel along a cylinder axis 16. The piston 15 has a piston skirt 18 (i.e. outer wall) that moves in close proximity with the cylinder 14 that requires lubrication during operation to avoid undesirable wear. A series of ports 20 extend through the lower portion of the cylinder 14. It is through these ports that at least one or both of the intake charge and the exhaust charge pass during operation of the internal combustion engine 12. It is also due to these ports, and the method of fueling the cylinder 14, that the method of crankcase lubrication used in a 4-stroke engine may have severe limitations or in some cases may not be used in an engine of this configuration.

In an exemplary embodiment, an oil supply annulus 26 extends substantially circumferentially about the outer surface 28 of the cylinder liner 12. A sealing band 30 extends about, and radially outwardly from, the oil supply annulus, to define an oil passage 32 therebetween. Other methods of defining the oil passage 32 may certainly be employed without deviating from the scope of the invention. The oil passage 32 is fluidly connected to an oil supply 34 by an oil supply line 36 extending therebetween. A one-way check valve 38 assures that oil flows only from the oil supply 34 to the oil passage and a metering orifice 40 and an electronic control valve 42 assist in controlling the quantity of oil delivered.

Turning now to the upper portion of the cylinder liner 12 and cylinder 14, a series of small openings 44 extend radially through the cylinder liner 12 from the cylinder 14 to the oil passage 32. The openings 44 are placed circumferentially about the cylinder 14 and the cylinder axis 16 and operate as oil passages for lubricating oil 46 from the oil supply 34 to flow to the upper portion of the cylinder 14. Oil exiting the openings 44 will be deposited on piston oil rings 47 as well as the piston skirt 18 to provide lubrication at the interface between the piston skirt and the cylinder. In an exemplary embodiment, the oil openings 44 are formed by laser drilling and would typically be on the order of 40-80 microns in diameter in size; the size depending upon the size of the cylinder liner 12 and the lubrication needs (ex. performance characteristics) of the engine. Due to the small size of the oil openings 44, the surface tension of the lubricating oil at the opening into the cylinder 14 prevents the oil 46 from leaking out consistently and over-lubricating the engine. Instead, the openings 44 define a porous cylinder wall portion 48 that provides the necessary lubrication for the upper portion of the cylinder 14.

During operation of the internal combustion engine 12, the flow of lubrication oil 46 to the oil supply annulus 26, and thus to the cylinder 14, is controlled by the oil pressure in the oil supply 34, the size of the metering orifice 40, and the percentage on-time of the control valve 42. In an exemplary embodiment, the control valve 42 is in signal communication with a controller 50, such as an engine controller, that monitors various operating parameters of the internal combustion engine 12 such as speed, temperature, load and other inputs that may affect the lubrication needs thereof. As those conditions vary, the controller 50 will vary the on-time of the control valve 42 to supply the appropriate quantity of lubricating oil 46 to the oil supply annulus 26 and through the series of small openings 44 to the cylinder 14.

Figure 2:
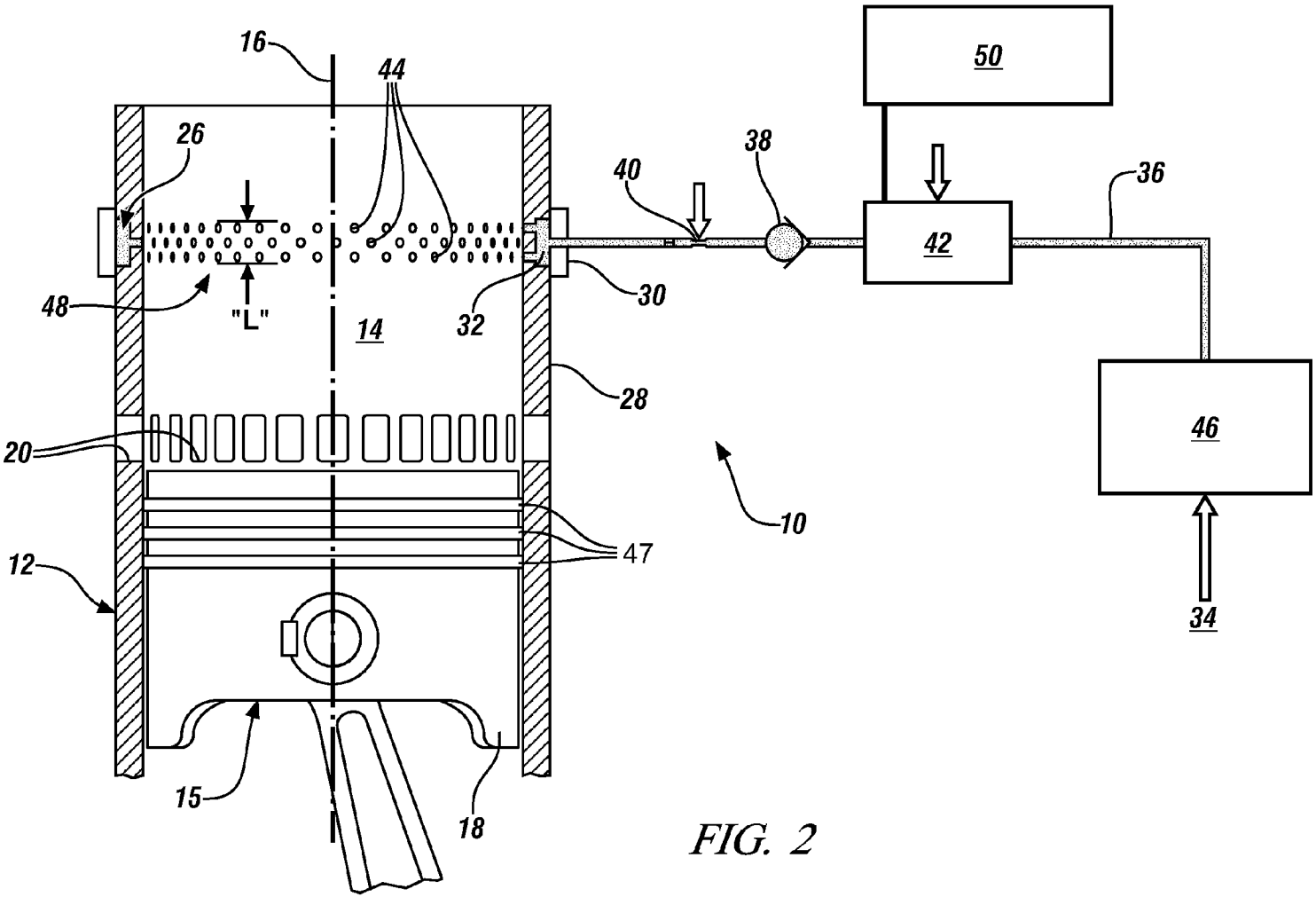
FIG. 2 is a schematic diagram of another embodiment of a lubrication system for an internal combustion engine embodying the invention.

In another exemplary embodiment of the invention illustrated in FIG. 2, the porous cylinder wall portion 48 of the cylinder 14 may comprise a longitudinally extending series of small openings 44 that extends axially along the cylinder axis 16 a distance "L". The holes may comprise a series of rows or may be in a random or semi-random layout. Such a dimensional porous cylinder wall portion 48 will provide greater lubrication capability for higher performance engines 12 as well as the possibility of greater oil flow control due to the enhanced surface area of the small openings 44.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed but that the invention will include all embodiments falling within the scope of the present application.

What is claimed is:

1. A cylinder lubrication system comprising;

a cylinder liner defining a cylinder;

a piston reciprocally mounted in the cylinder for axial travel along a cylinder axis between a lower portion of the cylinder liner and an upper portion of the cylinder liner, the piston having a piston skirt that moves in close proximity with the cylinder liner;

the cylinder liner defining one or more ports through the lower portion for passage of at least one of an intake charge and an exhaust charge;

a sealing band extending radially outward of and about the upper portion of the cylinder liner and defining an oil supply passage extending substantially circumferentially about the upper portion of the cylinder liner;

an oil supply line fluidly connecting the oil supply passage to an oil supply; and a series of small openings extending radially through the upper portion of the cylinder liner, from the cylinder to the oil supply passage, and defining oil passages for lubricating oil from the oil supply to flow to the cylinder.

2. The cylinder lubrication system of claim 1, wherein the series of small openings are formed by laser drilling.

3. The cylinder lubrication system of claim 1, wherein the series of small openings are on the order of 40-80 microns in diameter.

4. The cylinder lubrication system of claim 1, wherein the series of small openings define a porous cylinder wall portion.

5. The cylinder lubrication system of claim 1, further comprising a metering orifice disposed in the oil supply line to control the quantity of oil delivered from the oil supply to the oil supply passage.

6. The cylinder lubrication system of claim 1, further comprising an electronic control valve in fluid communication with the oil supply line to control the quantity of oil delivered from the oil supply to the oil supply passage.

7. The cylinder lubrication system of claim 6, further comprising a controller that monitors various operating parameters of the cylinder and varies the on-time of the control valve to supply the appropriate quantity of lubricating oil to the oil supply annulus through the series of small openings and to the cylinder.

8. The cylinder lubrication system of claim 7, wherein the operating parameters are one or more of speed, temperature and load.

9. The cylinder lubrication system of claim 1, wherein the porous cylinder wall portion of the cylinder comprises a longitudinally extending series of small holes that extends axially along the cylinder axis a distance "L".

10. The cylinder lubrication system of claim 9, wherein the holes may comprise a series of rows or may be in a random or semi-random layout.

11. The cylinder lubrication system of claim 1, wherein the cylinder comprises a 2-stroke engine.

12. The internal combustion engine of claim 1, further comprising a one-way check valve disposed in the oil supply line operable to prevent oil flow from the oil supply passage to the oil supply.

13. An internal combustion engine comprising;

a cylinder liner defining a cylinder;

a piston reciprocally mounted in the cylinder for axial travel along a cylinder axis between a lower portion of the cylinder liner and an upper portion of the cylinder liner;

the cylinder liner defining one or more ports through the lower portion for passage of at least one of an intake charge and an exhaust charge;

a sealing band extending radially outward of and about the upper portion of the cylinder liner and defining an oil supply passage extending substantially circumferentially about the upper portion of the cylinder liner;

an oil supply line fluidly connecting the oil supply passage to an oil supply and comprising a metering orifice disposed therein and an electronic control valve in fluid communication therewith to control the quantity of oil delivered to the oil supply passage; and a series of small, laser drilled openings, on the order of 40-80 microns in diameter, extending radially through the upper portion of the cylinder liner, from the cylinder to the oil supply passage, to define a porous wall portion of the upper portion of the cylinder comprising oil passages for lubricating the oil supply to flow to the upper portion of the cylinder liner.

14. The internal combustion engine of claim 13, further comprising a controller that monitors various engine operating parameters of the internal combustion engine and varies the on-time of the control valve to supply the appropriate quantity of lubricating oil to the oil supply annulus and through the series of small openings to the cylinder.

15. The internal combustion engine of claim 14, wherein the operating parameters are one or more of speed, temperature and load.

16. The internal combustion engine of claim 13, wherein the porous cylinder wall portion of the cylinder comprises a longitudinally extending series of small openings that extends axially along the cylinder axis a distance "L".

17. The internal combustion engine of claim 16, wherein the openings may comprise a series of rows or may be in a random or semi-random layout.

18. The internal combustion engine of claim 13, wherein the engine is a 2-stroke engine.

19. The cylinder lubrication system of claim 1, wherein the piston includes one or more piston rings disposed adjacent to the cylinder liner; and wherein the series of small openings is positioned so that oil exiting the series of small openings is deposited on piston oil rings to provide lubrication at an interface between the piston oil rings and the cylinder liner.

20. The cylinder lubrication system of claim 1, wherein the series of small openings is positioned so that oil exiting the series of small openings is deposited on the piston skirt to provide lubrication at an interface between the piston skirt and the cylinder liner.

* * * * *